US008919067B2

(12) United States Patent
Crosby et al.

(10) Patent No.: US 8,919,067 B2
(45) Date of Patent: Dec. 30, 2014

(54) APPARATUS AND METHOD FOR CONSTRUCTION OF STRUCTURES UTILIZING INSULATED CONCRETE FORMS

(71) Applicant: Airlite Plastics Co., Omaha, NE (US)

(72) Inventors: Bradley J. Crosby, Omaha, NE (US); Patrick D. Gredys, Omaha, NE (US); Glen Klassen, Winnipeg (CA)

(73) Assignee: Airlite Plastics Co., Omaha, NE (US)

( * ) Notice: Subject to any disclaimer, the term of this patent is extended or adjusted under 35 U.S.C. 154(b) by 0 days.

(21) Appl. No.: 13/665,130

(22) Filed: Oct. 31, 2012

(65) Prior Publication Data

US 2013/0125490 A1 May 23, 2013

Related U.S. Application Data

(60) Provisional application No. 61/553,712, filed on Oct. 31, 2011.

(51) Int. Cl.

| | |
|---|---|
| ***E04B 2/00*** | (2006.01) |
| ***E04C 5/00*** | (2006.01) |
| ***E04C 5/07*** | (2006.01) |

(52) U.S. Cl.

CPC .... *E04C 5/00* (2013.01); *E04C 5/07* (2013.01)
USPC ..... 52/439; 52/309.11; 52/426; 52/404.1; 249/191; 249/216

(58) Field of Classification Search

USPC ..... 52/309.7, 309.9, 309.11, 309.12, 426, 52/439, 105, 407.3, 404.1; 429/191, 213, 429/216, 38, 83, 40; 249/191, 213, 216, 38, 249/83, 40

See application file for complete search history.

(56) References Cited

U.S. PATENT DOCUMENTS

| | | | |
|---|---|---|---|
| 221,110 | A | 10/1879 | Shellenback et al. |
| 1,694,665 | A | 12/1928 | Parker |
| 1,796,973 | A | 3/1931 | Wright |
| 1,836,408 | A | 12/1931 | Sutton |
| 1,895,801 | A | 1/1933 | Keller |
| 1,983,040 | A | 12/1934 | Lyons |

(Continued)

FOREIGN PATENT DOCUMENTS

| | | |
|---|---|---|
| AU | 664029 | 9/1992 |
| AU | 685614 | 11/1995 |

(Continued)

OTHER PUBLICATIONS

English Translate of FR2977600A1 from EPO website (http://translationportal.epo.org/emtp/translate/?ACTION=description-retrieval&COUNTRY=FR&ENGINE=google&FORMAT=docdb&KIND=A1&LOCALE=en_EP&NUMBER=2977600&OPS=ops.epo.org&SRCLANG=fr&TRGLANG=en) on Feb. 18, 2014.*

(Continued)

*Primary Examiner* — Robert Canfield
*Assistant Examiner* — Babajide Demuren
(74) *Attorney, Agent, or Firm* — Banner & Witcoff, Ltd.

(57) ABSTRACT

An insulated concrete form including of first and second spaced sidewalls forming a cavity therebetween, said sidewalls having an inside surface and interconnected by a plurality of form ties, and a form insert made of an insulative material positioned adjacent the inside surface of at least one sidewall which thereby increases the R-value of the resulting structure.

23 Claims, 11 Drawing Sheets

(56) References Cited

U.S. PATENT DOCUMENTS 2,073,788 A 3/1937 Garvey et al.
2,177,246 A 10/1939 Ellis
2,199,112 A 4/1940 O'Leary
2,201,110 A 5/1940 Makram
2,452,463 A 10/1948 Herbert
2,498,276 A 2/1950 Kany
2,653,469 A * 9/1953 Callan ..... 52/274
3,255,562 A 6/1966 Altschuler
3,374,917 A 3/1968 Troy
3,383,817 A 5/1968 Gregori
3,422,588 A 1/1969 Stewart, Jr.
3,546,833 A 12/1970 Perreton
3,552,076 A 1/1971 Gregori
3,704,562 A 12/1972 Grants
3,740,909 A 6/1973 Stinnes
3,788,020 A 1/1974 Gregori
3,791,090 A 2/1974 Kniefel
3,885,363 A 5/1975 Whittey
3,895,469 A 7/1975 Kapitan
3,924,376 A 12/1975 Tsurumi
3,936,987 A 2/1976 Calvin
3,959,944 A 6/1976 Oroschakoff
3,968,615 A 7/1976 Ivany
3,992,844 A 11/1976 Gretter
4,021,989 A 5/1977 Hala
4,022,644 A 5/1977 Smith, Jr.
4,031,678 A 6/1977 Schuring
4,034,529 A 7/1977 Lampus
4,041,670 A 8/1977 Kaplan
4,060,952 A 12/1977 Hernandez
4,090,337 A 5/1978 Szekeres
4,107,895 A 8/1978 LeGrady
4,133,156 A 1/1979 Unger
4,185,423 A 1/1980 Gutierrez
4,223,501 A 9/1980 DeLozier
4,226,061 A 10/1980 Day, Jr.
4,229,920 A 10/1980 Lount
4,240,233 A 12/1980 Vercelletto
4,263,765 A 4/1981 Maloney
4,321,779 A 3/1982 Kratchmer
4,348,845 A 9/1982 Iannarelli
4,348,847 A 9/1982 Jukes
4,366,657 A 1/1983 Hopman
4,402,167 A 9/1983 Denucci
4,406,103 A 9/1983 Ghali et al.
4,407,102 A 10/1983 Boyack
4,411,118 A 10/1983 Claver
4,433,520 A 2/1984 Maschhoff
4,433,521 A 2/1984 Dietrich
4,433,522 A 2/1984 Yerushalmi
4,438,612 A 3/1984 Bernard et al.
4,439,967 A 4/1984 Dielenberg
4,442,644 A 4/1984 Jukes
4,471,590 A 9/1984 Roberts et al.
4,479,338 A 10/1984 Robertson
4,516,372 A 5/1985 Grutsch
4,551,870 A 11/1985 Presti, Jr.
4,557,093 A 12/1985 Beliveau
4,557,094 A 12/1985 Beliveau
4,571,909 A 2/1986 Berghuis et al.
4,574,550 A * 3/1986 Maschhoff ..... 52/405.3
4,577,447 A 3/1986 Doran
4,598,519 A 7/1986 Reid
4,599,830 A 7/1986 Nawrot
4,604,843 A 8/1986 Ott et al.
4,628,652 A 12/1986 Wefels
4,629,192 A 12/1986 Nichols
4,632,796 A 12/1986 Moulet
4,648,228 A 3/1987 Kiselewski
4,655,014 A 4/1987 Krecke
4,698,947 A 10/1987 McKay
4,700,523 A 10/1987 Kohara
4,706,429 A 11/1987 Young
4,730,422 A 3/1988 Young
4,731,968 A 3/1988 Obino
4,742,659 A 5/1988 Meilleur
4,750,307 A 6/1988 Slager
4,750,308 A 6/1988 McKay
4,765,109 A 8/1988 Boeshart
4,773,199 A 9/1988 Kohara
4,788,020 A 11/1988 Yampolsky et al.
4,791,767 A 12/1988 Boeshart
4,809,470 A * 3/1989 Bauer et al. ..... 52/97
4,811,927 A 3/1989 Slonimsky et al.
4,817,353 A 4/1989 Woods et al.
4,825,618 A 5/1989 Blevins
4,835,928 A 6/1989 Scott
4,852,317 A 8/1989 Schiavello et al.
4,860,515 A 8/1989 Browning, Jr.
4,862,660 A 9/1989 Raymond
4,864,792 A 9/1989 Andre et al.
4,866,891 A 9/1989 Young
4,879,855 A 11/1989 Berrenberg
4,883,396 A 11/1989 Shamah et al.
4,884,382 A 12/1989 Horobin
4,885,888 A 12/1989 Young
4,888,931 A 12/1989 Meilleur
4,889,310 A 12/1989 Boeshart
4,894,969 A 1/1990 Horobin
4,901,494 A 2/1990 Miller et al.
4,916,879 A 4/1990 Boeshart
4,936,540 A 6/1990 Boeshart
4,938,449 A 7/1990 Boeshart
4,949,515 A 8/1990 Krecke
4,967,528 A 11/1990 Doran
4,972,646 A 11/1990 Miller et al.
4,974,388 A 12/1990 Fischer
4,976,081 A 12/1990 Litzenberger
4,998,394 A 3/1991 Holzapfel et al.
5,014,480 A 5/1991 Guarriello et al.
5,024,035 A 6/1991 Hanson et al.
5,060,446 A 10/1991 Beliveau
5,065,561 A 11/1991 Mason
5,086,600 A 2/1992 Holland et al.
5,092,093 A 3/1992 Lu
5,097,644 A 3/1992 Hun
5,099,628 A 3/1992 Noland et al.
5,099,630 A 3/1992 Bolmgren
5,107,648 A 4/1992 Roby
5,117,600 A 6/1992 Yerushalmi
5,122,015 A 6/1992 Shen
5,123,222 A 6/1992 Guarriello et al.
5,140,794 A 8/1992 Miller
5,163,261 A 11/1992 O'Neill
5,174,083 A 12/1992 Mussell
D335,542 S 5/1993 Bird
5,212,842 A 5/1993 Glydon
5,215,490 A 6/1993 Szoradi
D343,426 S 1/1994 Sher
D343,427 S 1/1994 Sher
5,323,578 A 6/1994 Chagnon et al.
5,337,530 A 8/1994 Beames
5,350,256 A 9/1994 Hammer
5,351,455 A 10/1994 Schoonover et al.
5,351,456 A 10/1994 Paine, Jr.
5,390,459 A 2/1995 Mensen
5,428,933 A 7/1995 Philippe
5,454,199 A 10/1995 Blom et al.
5,459,970 A 10/1995 Kim
5,459,971 A 10/1995 Sparkman
5,465,542 A 11/1995 Terry
5,473,850 A 12/1995 Balding
5,491,949 A 2/1996 De Moor
D370,503 S 6/1996 Burns
5,535,565 A 7/1996 Majnaric et al.
5,537,797 A 7/1996 Harkenrider et al.
5,553,430 A 9/1996 Majnaric et al.
5,566,518 A 10/1996 Martin et al.
5,566,519 A 10/1996 Almaraz-Miera
5,566,521 A 10/1996 Andrews et al.
5,568,710 A 10/1996 Smith et al.
5,570,552 A 11/1996 Nehring
5,596,855 A 1/1997 Batch
5,598,675 A 2/1997 Pruss

(56) References Cited

U.S. PATENT DOCUMENTS

| | | | | |
|---|---|---|---|---|
| 5,608,999 | A | 3/1997 | McNamara | |
| 5,611,182 | A | 3/1997 | Spude | |
| 5,611,183 | A | 3/1997 | Kim | |
| 5,617,693 | A | 4/1997 | Hefner | |
| 5,625,989 | A | 5/1997 | Brubaker et al. | |
| 5,632,126 | A | 5/1997 | Agsten | |
| 5,638,652 | A | 6/1997 | Shinoda et al. | |
| 5,649,401 | A | 7/1997 | Harrington, Jr. | |
| 5,653,082 | A | 8/1997 | Shinoda et al. | |
| 5,657,600 | A | 8/1997 | Mensen | |
| 5,657,601 | A | 8/1997 | Bean et al. | |
| 5,658,483 | A | 8/1997 | Boeshart | |
| 5,678,369 | A | 10/1997 | Ishikawa et al. | |
| 5,688,078 | A | 11/1997 | Hammer | |
| 5,692,356 | A | 12/1997 | Baxter | |
| 5,695,676 | A | 12/1997 | Lee | |
| 5,699,640 | A | 12/1997 | Bourgeois et al. | |
| 5,701,710 | A | 12/1997 | Tremelling | |
| 5,704,180 | A | 1/1998 | Boeck | |
| 5,709,060 | A | 1/1998 | Vaughan et al. | |
| 5,709,061 | A | 1/1998 | Dietrich | |
| 5,735,093 | A | 4/1998 | Grutsch | |
| 5,740,648 | A | 4/1998 | Piccone | |
| 5,768,851 | A | 6/1998 | Nagaoka | |
| 5,782,050 | A | 7/1998 | Boeshart | |
| 5,802,793 | A | 9/1998 | DeVore, Jr. | |
| 5,802,795 | A | 9/1998 | Myers et al. | |
| 5,803,669 | A | 9/1998 | Bullard | |
| 5,809,723 | A | 9/1998 | Keith et al. | |
| 5,809,725 | A | 9/1998 | Cretti | |
| 5,809,726 | A | 9/1998 | Spude | |
| 5,809,727 | A | 9/1998 | Mensen | |
| 5,809,728 | A | 9/1998 | Tremelling | |
| 5,813,174 | A * | 9/1998 | Waller | 52/79.1 |
| 5,818,997 | A | 10/1998 | Fasanella et al. | |
| 5,819,489 | A | 10/1998 | McKinney | |
| 5,822,939 | A * | 10/1998 | Haener | 52/405.2 |
| 5,836,126 | A | 11/1998 | Harkenrider et al. | |
| 5,839,243 | A | 11/1998 | Martin | |
| 5,845,445 | A | 12/1998 | Blackbeard | |
| 5,845,449 | A | 12/1998 | Vaughan et al. | |
| 5,845,455 | A | 12/1998 | Johnson, III | |
| 5,852,907 | A | 12/1998 | Tobin et al. | |
| 5,853,314 | A | 12/1998 | Bora | |
| 5,857,300 | A | 1/1999 | Gates | |
| 5,860,262 | A | 1/1999 | Johnson | |
| 5,881,524 | A | 3/1999 | Ellison, Jr. | |
| 5,887,401 | A | 3/1999 | Moore, Jr. | |
| 5,890,337 | A | 4/1999 | Boeshart | |
| 5,893,248 | A | 4/1999 | Beliveau | |
| 5,895,188 | A | 4/1999 | Cheng | |
| 5,896,714 | A | 4/1999 | Cymbala et al. | |
| 5,918,427 | A | 7/1999 | VanderWerf | |
| 5,930,958 | A | 8/1999 | Stanley | |
| 5,930,970 | A | 8/1999 | De Le fevre | |
| 5,937,604 | A | 8/1999 | Bowron | |
| 5,945,448 | A | 8/1999 | Ninomiya et al. | |
| 5,987,830 | A | 11/1999 | Worley | |
| 5,992,114 | A | 11/1999 | Zelinsky et al. | |
| 6,000,184 | A | 12/1999 | Fernandes | |
| 6,070,380 | A | 6/2000 | Meilleur | |
| 6,085,476 | A | 7/2000 | Jantzi et al. | |
| 6,112,491 | A | 9/2000 | Keith et al. | |
| 6,122,880 | A | 9/2000 | Kolb et al. | |
| 6,131,360 | A | 10/2000 | Dalen | |
| 6,148,576 | A | 11/2000 | Janopaul, Jr. | |
| 6,151,856 | A | 11/2000 | Shimonohara | |
| 6,167,671 | B1 | 1/2001 | Wilson | |
| 6,170,220 | B1 | 1/2001 | Moore, Jr. | |
| 6,173,937 | B1 | 1/2001 | Cottongim | |
| 6,176,059 | B1 | 1/2001 | Cantarano et al. | |
| 6,219,984 | B1 | 4/2001 | Piccone | |
| 6,224,031 | B1 | 5/2001 | Boeshart | |
| 6,226,951 | B1 | 5/2001 | Azar | |
| 6,230,462 | B1 | 5/2001 | Beliveau | |
| 6,231,024 | B1 | 5/2001 | Kugimiya et al. | |
| 6,231,025 | B1 | 5/2001 | Takemura | |
| 6,233,897 | B1 | 5/2001 | Jurik | |
| 6,240,692 | B1 | 6/2001 | Yost et al. | |
| 6,250,024 | B1 | 6/2001 | Sculthorpe et al. | |
| 6,250,033 | B1 | 6/2001 | Zelinsky | |
| 6,252,523 | B1 | 6/2001 | Mostrom | |
| 6,253,518 | B1 | 7/2001 | Azar | |
| 6,253,519 | B1 | 7/2001 | Daniel | |
| 6,253,523 | B1 | 7/2001 | McKinnon | |
| 6,263,631 | B1 | 7/2001 | Nisbett et al. | |
| 6,263,638 | B1 * | 7/2001 | Long, Sr. | 52/794.1 |
| 6,276,104 | B1 | 8/2001 | Long, Sr. et al. | |
| 6,276,549 | B1 | 8/2001 | Fasci et al. | |
| 6,279,285 | B1 | 8/2001 | Kubica | |
| 6,279,287 | B1 | 8/2001 | Meadows | |
| 6,293,059 | B1 | 9/2001 | Goodwin | |
| 6,293,067 | B1 | 9/2001 | Meendering | |
| 6,293,068 | B1 | 9/2001 | Harrington, Jr. | |
| 6,301,851 | B1 | 10/2001 | Matsubara | |
| 6,308,484 | B1 | 10/2001 | Severino | |
| 6,314,694 | B1 | 11/2001 | Cooper et al. | |
| 6,314,697 | B1 | 11/2001 | Moore, Jr. | |
| 6,318,040 | B1 | 11/2001 | Moore, Jr. | |
| 6,321,496 | B1 | 11/2001 | Martin, Jr. | |
| 6,321,497 | B1 | 11/2001 | Cormier | |
| 6,321,498 | B1 | 11/2001 | Trovato | |
| 6,324,804 | B1 | 12/2001 | Hoogstraten | |
| 6,332,300 | B1 | 12/2001 | Wakai | |
| 6,336,301 | B1 | 1/2002 | Moore, Jr. | |
| 6,349,520 | B2 | 2/2002 | Kubica | |
| 6,352,237 | B1 | 3/2002 | Severino | |
| 6,360,505 | B1 | 3/2002 | Johns | |
| 6,363,683 | B1 | 4/2002 | Moore, Jr. | |
| 6,378,260 | B1 | 4/2002 | Williamson et al. | |
| 6,378,261 | B1 | 4/2002 | Agsten | |
| 6,401,413 | B1 | 6/2002 | Niemann | |
| 6,401,419 | B1 | 6/2002 | Beliveau | |
| 6,405,505 | B1 | 6/2002 | Alberti | |
| 6,412,231 | B1 | 7/2002 | Palatin | |
| 6,438,917 | B2 | 8/2002 | Kubica | |
| 6,438,918 | B2 | 8/2002 | Moore, Jr. et al. | |
| 6,474,033 | B1 | 11/2002 | Luchini et al. | |
| 6,481,178 | B2 | 11/2002 | Moore, Jr. | |
| 6,519,906 | B2 | 2/2003 | Yost et al. | |
| 6,526,713 | B2 | 3/2003 | Moore, Jr. | |
| 6,536,172 | B1 | 3/2003 | Amend | |
| 6,568,141 | B2 | 5/2003 | Kremers | |
| 6,574,934 | B1 | 6/2003 | Queirel | |
| 6,578,333 | B1 | 6/2003 | Gagliano | |
| 6,609,340 | B2 | 8/2003 | Moore, Jr. et al. | |
| 6,625,947 | B1 * | 9/2003 | Burgett | 52/424 |
| 6,647,686 | B2 | 11/2003 | Dunn et al. | |
| 6,665,992 | B2 | 12/2003 | Hew | |
| 6,668,502 | B2 | 12/2003 | Beliveau | |
| 6,668,503 | B2 | 12/2003 | Beliveau | |
| 6,681,539 | B2 | 1/2004 | Yost et al. | |
| 6,688,066 | B1 | 2/2004 | Cottier et al. | |
| 6,691,481 | B2 | 2/2004 | Schmidt | |
| 6,698,710 | B1 * | 3/2004 | VanderWerf | 249/216 |
| 6,761,007 | B2 | 7/2004 | Lancelot, III et al. | |
| 6,792,729 | B2 | 9/2004 | Beliveau | |
| 6,820,384 | B1 | 11/2004 | Pfeiffer | |
| 7,059,577 | B1 | 6/2006 | Burgett | |
| 7,082,731 | B2 | 8/2006 | Patz et al. | |
| 2005/0204679 | A1 | 9/2005 | Pfeiffer | |
| 2005/0223669 | A1 | 10/2005 | Cymbala et al. | |
| 2006/0117693 | A1 | 6/2006 | Garrett | |
| 2006/0213140 | A1 | 9/2006 | Morin et al. | |
| 2009/0013629 | A1 * | 1/2009 | Boeshart | 52/426 |
| 2009/0120027 | A1 * | 5/2009 | Amend | 52/426 |

FOREIGN PATENT DOCUMENTS

| | | |
|---|---|---|
| CA | 256091 | 12/1925 |
| CA | 443900 | 9/1947 |
| CA | 2028992 | 3/1992 |
| CA | 2142517 | 8/1995 |
| CA | 2182055 | 6/1997 |

(56) References Cited

FOREIGN PATENT DOCUMENTS

| | | |
|---|---|---|
| CA | 2298435 | 9/1998 |
| CA | 2224949 | 6/1999 |
| CA | 2492969 | 8/2005 |
| CA | 2500682 | 9/2005 |
| CN | 1075183 | 8/1993 |
| CN | 2142861 | 9/1993 |
| CN | 2177759 | 9/1994 |
| CN | 2213769 | 11/1995 |
| CN | 1113283 | 12/1995 |
| CN | 2219338 | 2/1996 |
| CN | 2232465 | 8/1996 |
| CN | 2264219 | 10/1997 |
| CN | 2265413 | 10/1997 |
| CN | 1174922 | 3/1998 |
| CN | 1177390 | 3/1998 |
| CN | 2277430 | 4/1998 |
| CN | 2291457 | 9/1998 |
| CN | 2307851 | 2/1999 |
| CN | 2315178 | 4/1999 |
| CN | 2318290 | 5/1999 |
| CN | 2326651 | 6/1999 |
| CN | 2329720 | 7/1999 |
| CN | 2330727 | 7/1999 |
| CN | 1230237 | 9/1999 |
| CN | 2346856 | 11/1999 |
| CN | 2360486 | 1/2000 |
| DE | 2394647 | 1/1979 |
| DE | 3233470 | 3/1984 |
| DE | 3315942 | 11/1984 |
| DE | 4415406 | 11/1995 |
| DE | 4434057 | 3/1996 |
| DE | 19548440 | 4/1997 |
| FR | 2977600 A1 * | 1/2013 |
| GB | 190013282 | 5/1901 |
| GB | 157638 | 1/1921 |
| GB | 162104 | 4/1921 |
| GB | 189481 | 11/1922 |
| GB | 296834 | 9/1928 |
| GB | 442286 | 1/1936 |
| GB | 442223 | 2/1936 |
| GB | 488640 | 7/1938 |
| GB | 508283 | 6/1939 |
| GB | 516873 | 1/1940 |
| GB | 517915 | 2/1940 |
| GB | 552692 | 4/1943 |
| GB | 600513 | 4/1948 |
| GB | 1385045 | 2/1975 |
| GB | 2162221 | 1/1986 |
| GB | 2170258 | 7/1986 |
| GB | 2240121 | 7/1991 |
| WO | 9512720 | 5/1995 |
| WO | 9905370 | 2/1999 |
| WO | 233184 | 4/2002 |
| ZA | 9702802 | 10/1998 |

OTHER PUBLICATIONS

Portland Cement Association, Prescriptive Design of Exterior Concrete Walls for One- and Two-Family Dwellings (2008), 123 pages.

NAHB Research Center, Inc., Prescriptive Method for Insulating Concrete Forms in Residential Construction (2008), 100 pages.

NAHB Research Center, Inc., Prescriptive Method for Insulating Concrete Forms in Residential Construction (2d ed. 2002), 62 pages.

Pieter A. VanderWerf et al., Insulating Concrete Forms (McGraw-Hill 1997).

* cited by examiner

APPARATUS AND METHOD FOR CONSTRUCTION OF STRUCTURES UTILIZING INSULATED CONCRETE FORMS

FIELD OF THE INVENTION

This application claims priority from U.S. Provisional Application No. 61/553,712, entitled, "An Apparatus and Method for Construction of Structures Utilizing Insulated Concrete Forms," filed on Oct. 31, 2011 and which is herein incorporated by reference in its entirety.

BACKGROUND OF THE INVENTION

Insulated concrete forms (ICFs) of variable design comprise an increasingly important and popular product for construction of building and other structures. Such ICF products typically include a pair of spaced sidewalls fabricated from an insulating material. The paired sidewalls are maintained in a spaced relationship by connecting ties. The ties may be configured to support reinforcing bars (rebar). The ICF products are modular sizes and designed to be stacked to thereby provide a form adapted to receive poured concrete in the space between the sidewalls, thereby resulting in a poured concrete structure intermediate sidewalls of an insulating material. An example of ICF products are depicted in U.S. Pat. No. 7,861,479, which is incorporated by reference as if fully set forth herein.

BRIEF DESCRIPTION OF THE DRAWINGS

Further details, aspects, and embodiments of the subject matter of this disclosure will be described, by way of example only, with reference to the drawings.

SUMMARY

An insulated concrete form including of first and second spaced sidewalls forming a cavity therebetween, said sidewalls having an inside surface and interconnected by a plurality of form ties, and a form insert made of an insulative material positioned adjacent the inside surface of at least one sidewall which thereby increases the R-value of the resulting structure.

A method for construction of structures utilizing insulated concrete forms comprising, positioning a course of a plurality of insulating concrete forms such that the course is adapted to receive poured concrete, wherein the course comprises a portion of a structure and wherein the course includes a plurality of interconnected exterior sidewalls having outside surface and an inside surface and positioning a plurality of form inserts in contact with the inside surface of the interconnected exterior sidewalls such that the form inserts cover ate least about 80% of the surface area of the inside surface.

DETAILED DESCRIPTION

Aspects of this disclosure can be applied in the construction of structures utilizing insulated concrete forms. One advantage of use of an insert as described herein is to increase the resistance to heat flow or R-Value of such structures in an efficient and cost effective manner. The higher the R-Value, the more effectively the structure resists heat flow. Another advantage of use of an insert as described herein is that it may be used with existing designs of insulated concrete forms. Additional advantages of an insert as described herein include ease of installation, reduction of waste, and decreased incidence of human error in the construction of structures utilizing insulating concrete forms. These and other advantages of use of an insert as described herein are apparent from the description below and the accompanying drawings.

Figure 1:
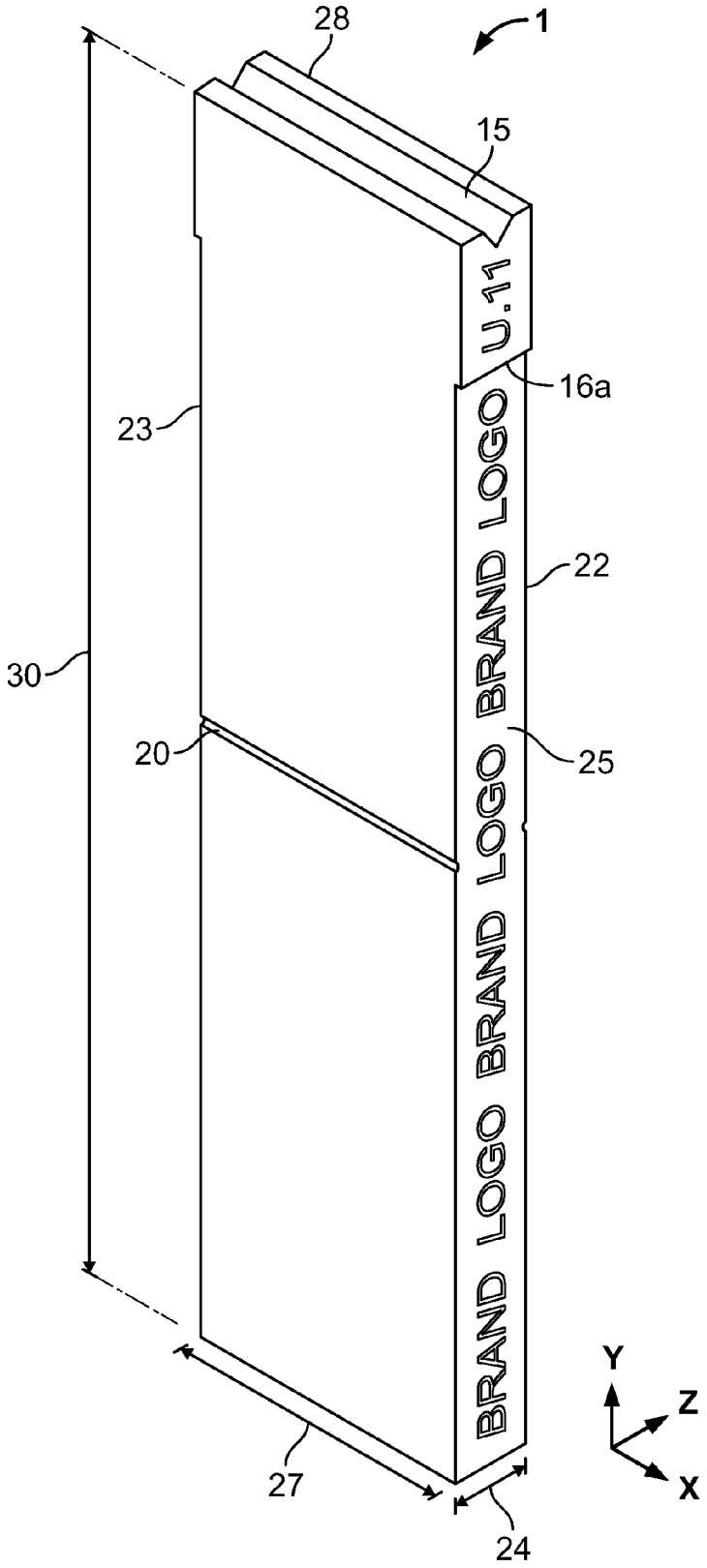
FIG. 1 is a top, front perspective view of an embodiment of a form insert for use construction of structures utilizing insulated concrete forms.
Figure 2:
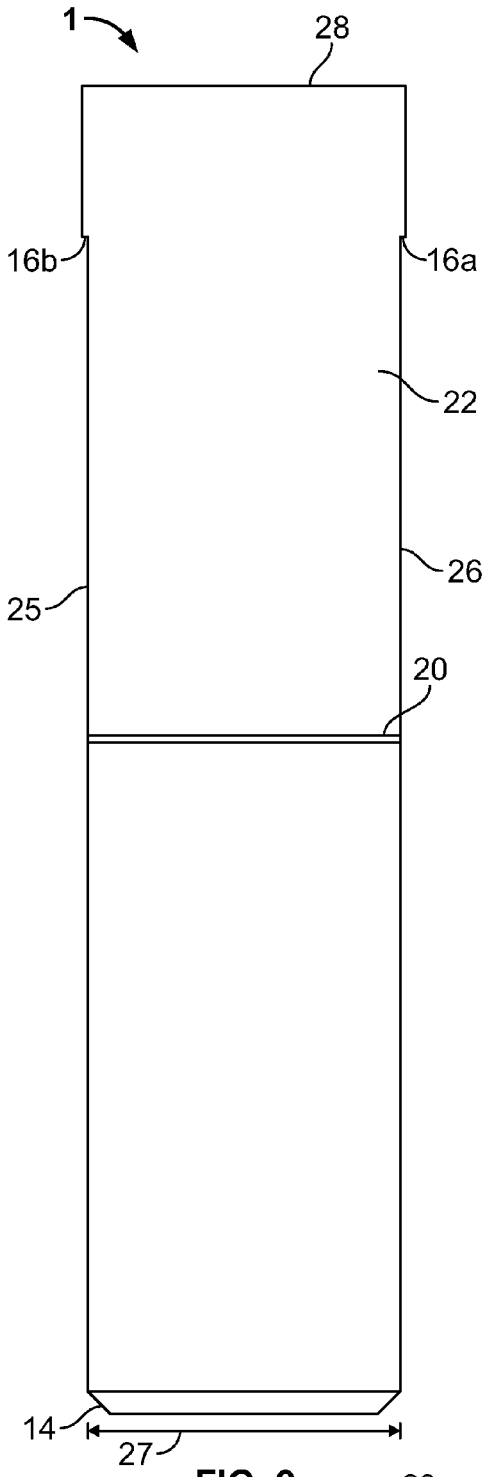
FIG. 2 is an elevational view of the embodiment of FIG. 1.
Figure 3:
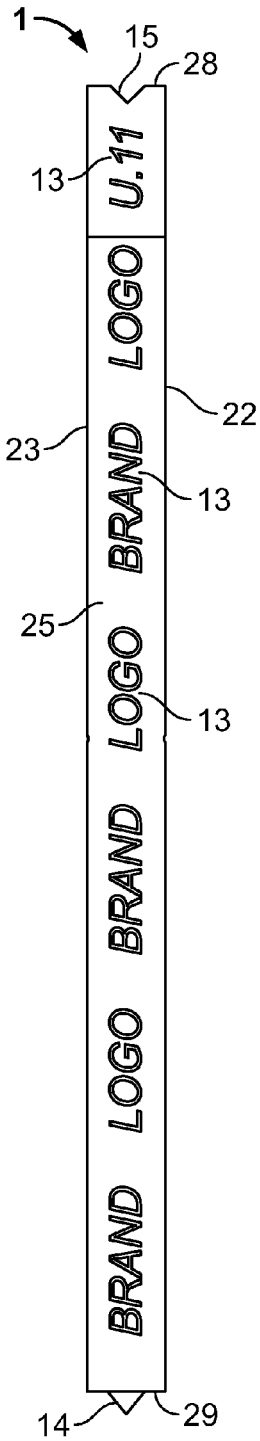
FIG. 3 is a front side view the embodiment of FIG. 1.
Figure 4:
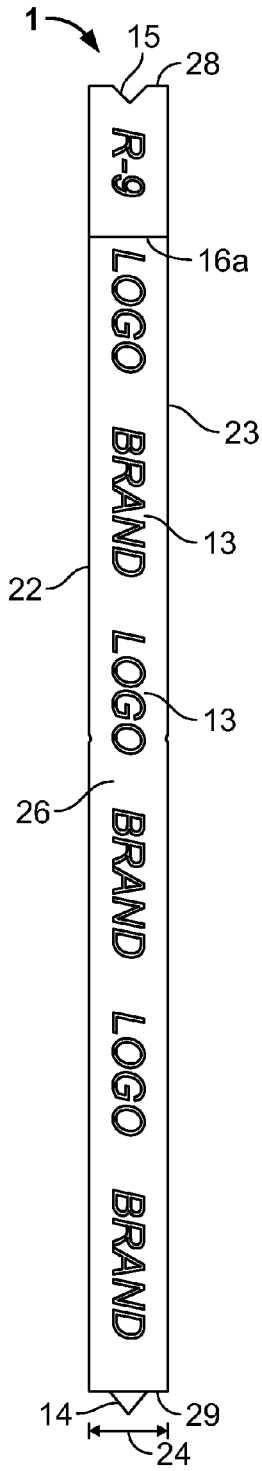
FIG. 4 is a rear side view of the embodiment of FIG. 1.
Figure 5:
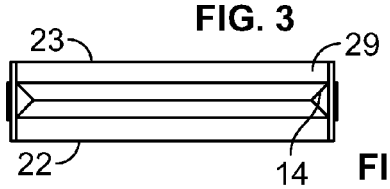
FIG. 5 is a bottom view of the embodiment of FIG. 1.
Figure 6:
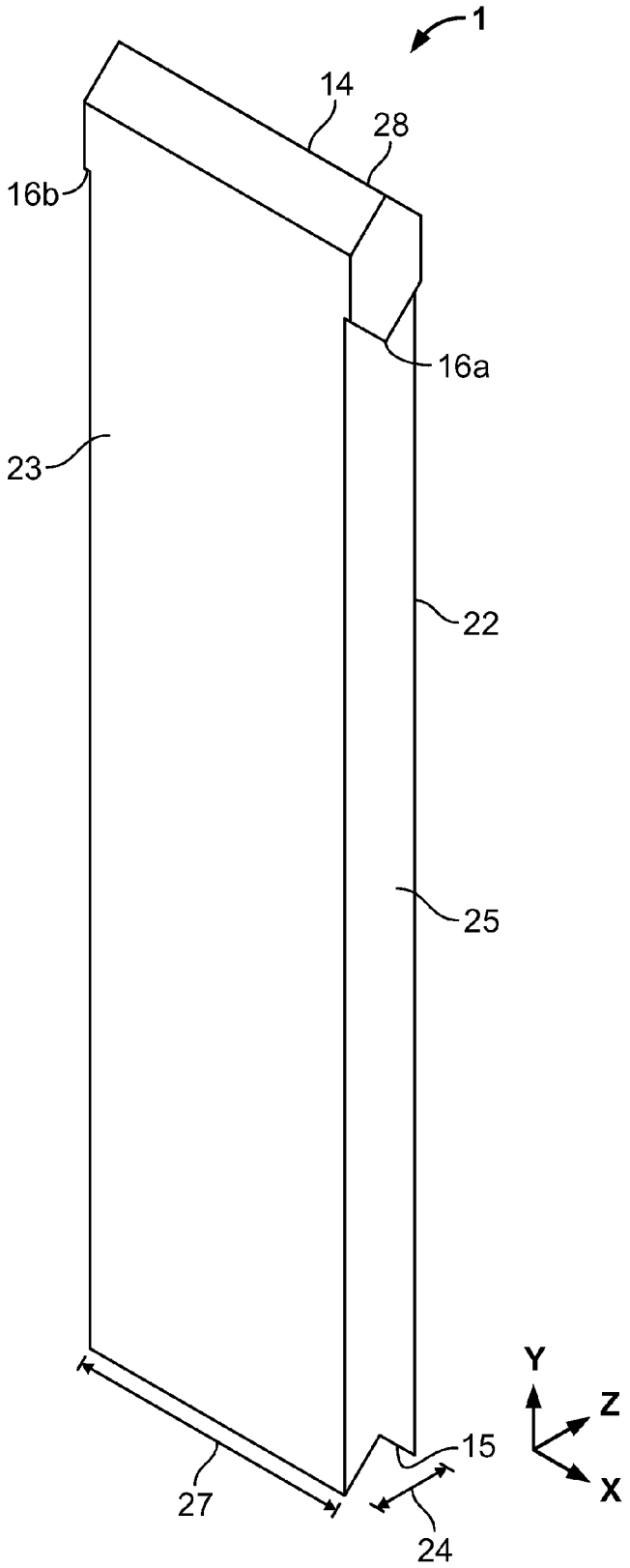
FIG. 6 is a top, front perspective view of an embodiment of a form insert for use construction of structures utilizing insulated concrete forms.
Figure 10:
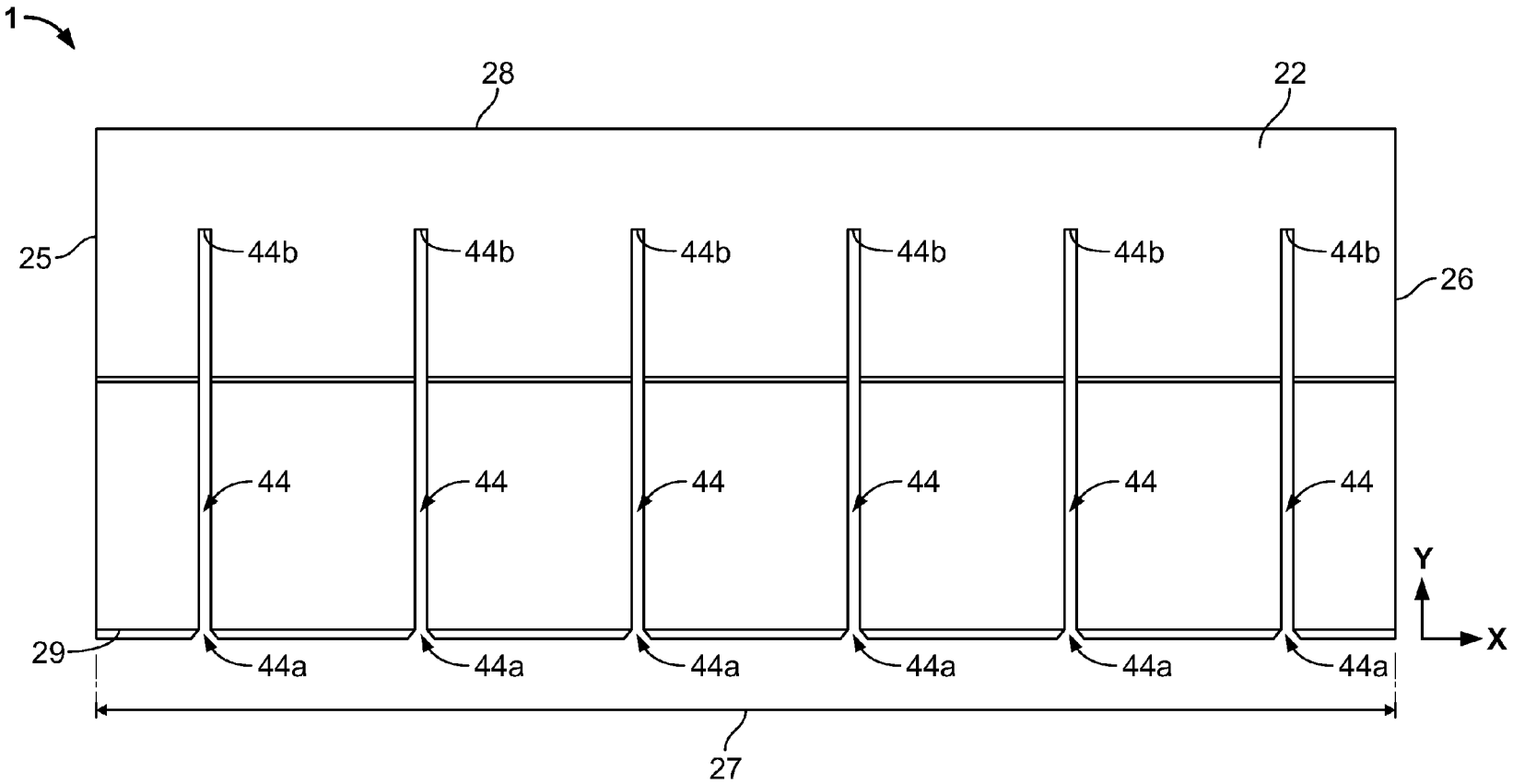
FIG. 10 is an elevational view of the embodiment of an embodiment of a form insert for use construction of structures utilizing insulated concrete forms.

Referring to FIGS. 1-4, in an embodiment, a form insert (1) is formed of insulative material. A form insert may also be referred to herein as an insert. Suitable insulative materials include, for example, expanded polystyrene (EPS) foam and other materials used as insulative material for insulated concrete forms (2). In an embodiment, a form insert (1) can be formed of an insulative material that is different than the insulative material of the insulated concrete form (2). For example, a form insert (1) can be formed of an insulative material which has greater insulative properties than the insulative material of the form. For example, a form insert can be formed of graphite modified EPS foam while the insulated concrete form can be made of white modified EPS. In an embodiment, an insert (1) can be manufactured by, for example, molding or wire cutting EPS foam into a suitable dimension and shape, such as for example the dimension and shape shown in the figures. FIG. 6 depicts an embodiment of a form insert (1). FIG. 10 depicts an embodiment of a form insert (1).

Referring to the Figures by example, in an embodiment, a form insert (1) can include a form insert outward face (22), a form insert inward face (23), and a form insert thickness (24) defined in a first horizontal direction (z) between the form insert outward face (22) and the form insert inward face (23). The form insert (1) can include a form insert front side (25), a form insert rear side (26), and a form insert length (27) defined in a second horizontal direction (x) between the form insert front side (25) and the form insert rear side (26). The form insert (1) can include a form insert top surface (28), a form insert bottom surface (29), and a form insert height (30) defined in the vertical direction (y) between the form insert top surface (28) and the form insert bottom surface (29).

Figure 7A:
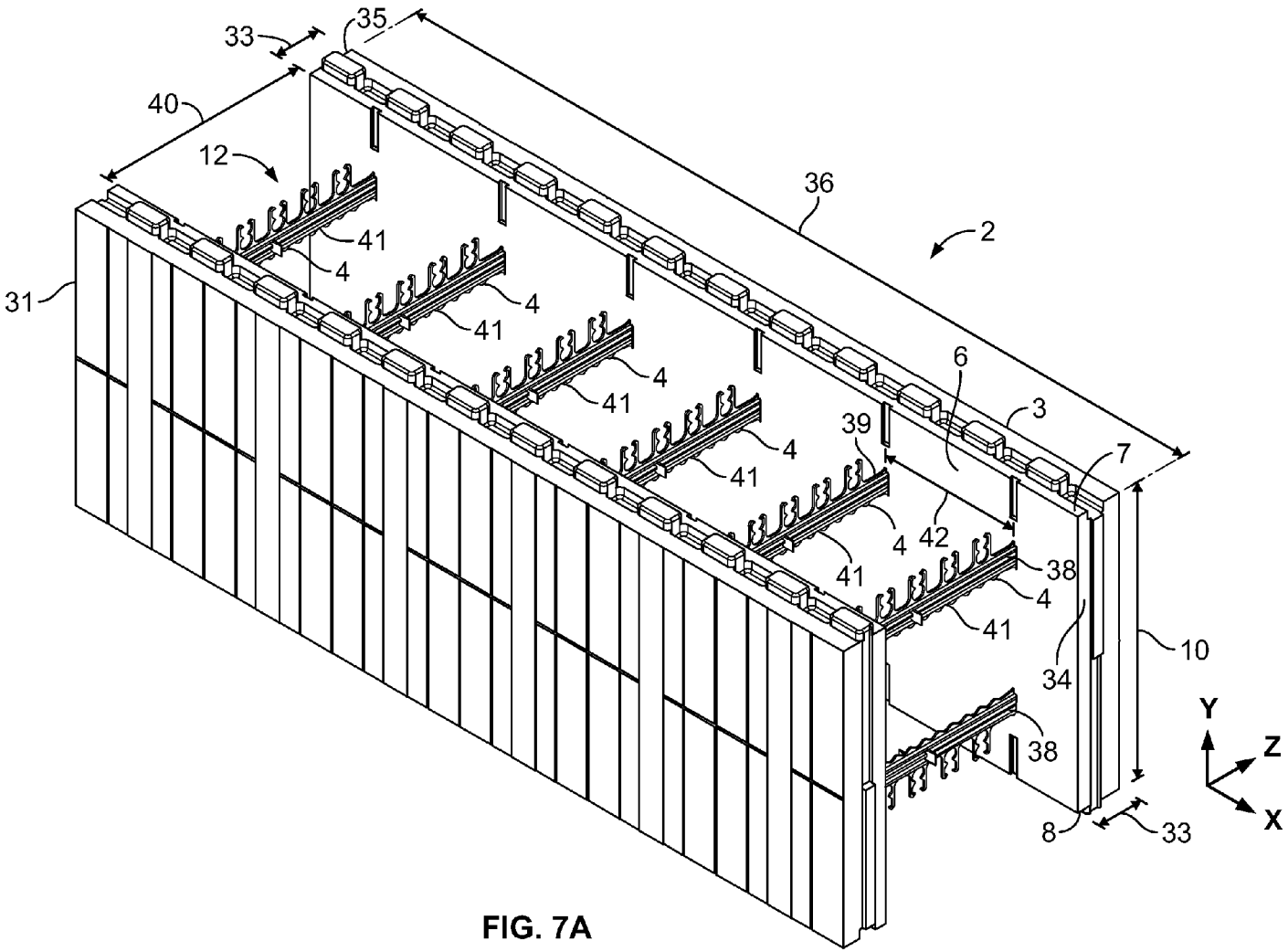
FIG. 7A is a top, front perspective view of an example of an insulating concrete form.
Figure 7B:
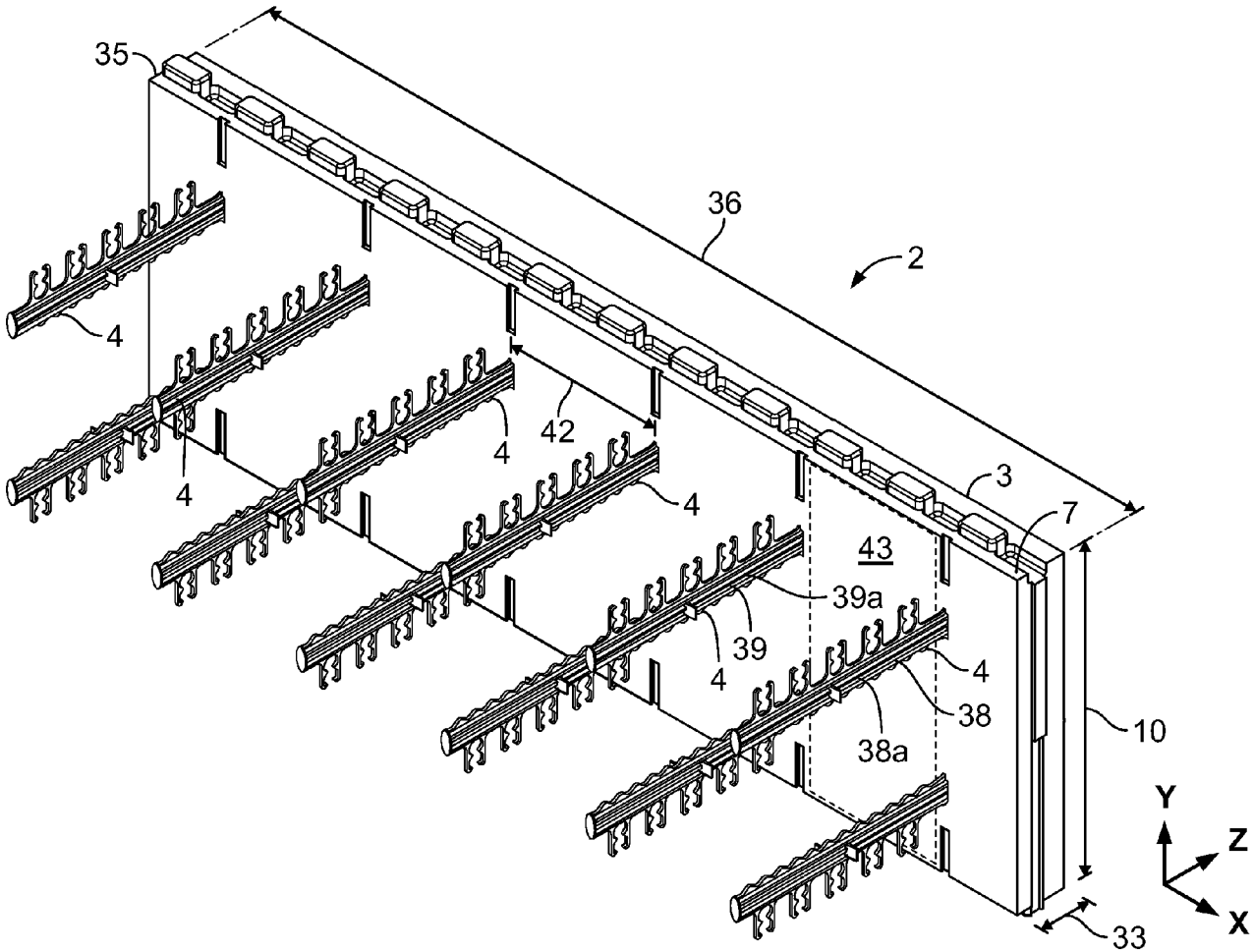
FIG. 7B is a top, front perspective view of an example of an insulating concrete form with a sidewall removed to show the inside surface of a sidewall of the insulating concrete form.

Referring to the FIGS. 7A and 7B, an example insulated concrete form (2) can include a first sidewall (3), a second sidewall (31), and a plurality of form ties (4). The first sidewall can include an inside surface (6), an outside surface (32), and a first sidewall thickness (33) defined in a first horizontal direction (z) between the inside surface (6) and the outside surface (32). The first sidewall (3) can include a first sidewall top surface (7), a first sidewall bottom surface (8), and a first sidewall height (10) defined in a vertical direction (y) between the first sidewall top surface (7) and the first sidewall bottom surface (8). The first sidewall (3) can include a first sidewall front side (34), a first sidewall rear side (35), and a first sidewall length (36) defined in a second horizontal direction (x) between the first sidewall front side (34) and the first sidewall rear side (35). The plurality of form ties can include a first form tie (38) and a second form tie (39). The first form tie (38) and second form tie (39) can, also with other form ties (4), connect the first sidewall (3) to the second sidewall (31) such that the form ties (4) space the first sidewall from the second sidewall to define a cavity (12) between the first sidewall (3) and the second sidewall (31), wherein a cavity thickness (40) is defined in the first horizontal direction (z) spanning between the first sidewall (3) and the second sidewall (31). The form ties (4) can include a plurality of lateral members (41) oriented transverse the first sidewall and the second sidewalls and being spaced a distance from at least one other of the plurality of lateral members in the second horizontal direction (x). In an embodiment, such distance can correspond to a form tie spacing distance (42), which can be the distance that each form tie (4) is spaced. The form tie spacing distance (42) can be, for example, 8 inches on center.

Figure 7C:
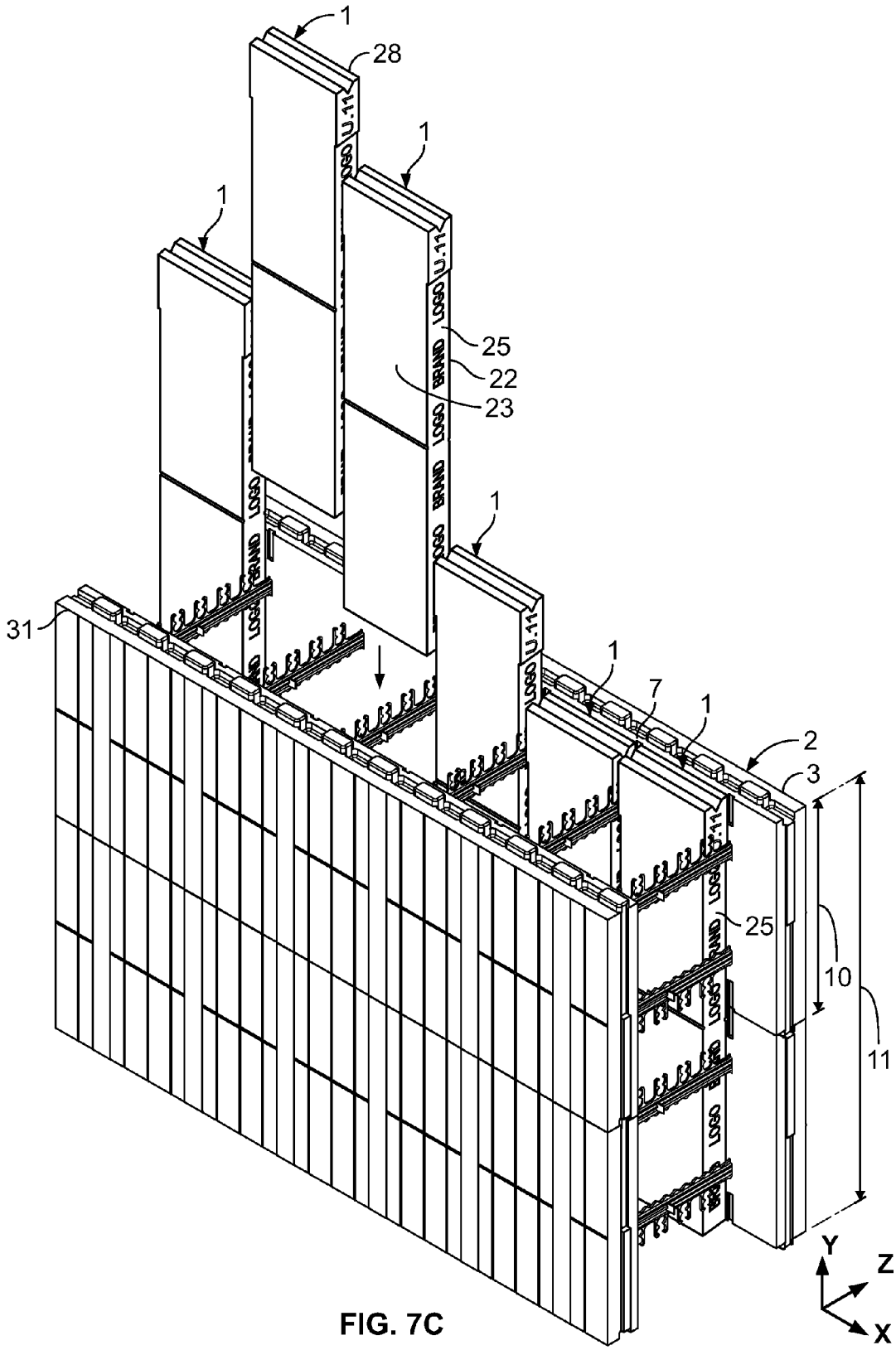
FIG. 7C depicts a plurality of the embodiments of the form insert of FIG. 1 installed in a stack of multiple insulated concrete forms.
Figure 8:
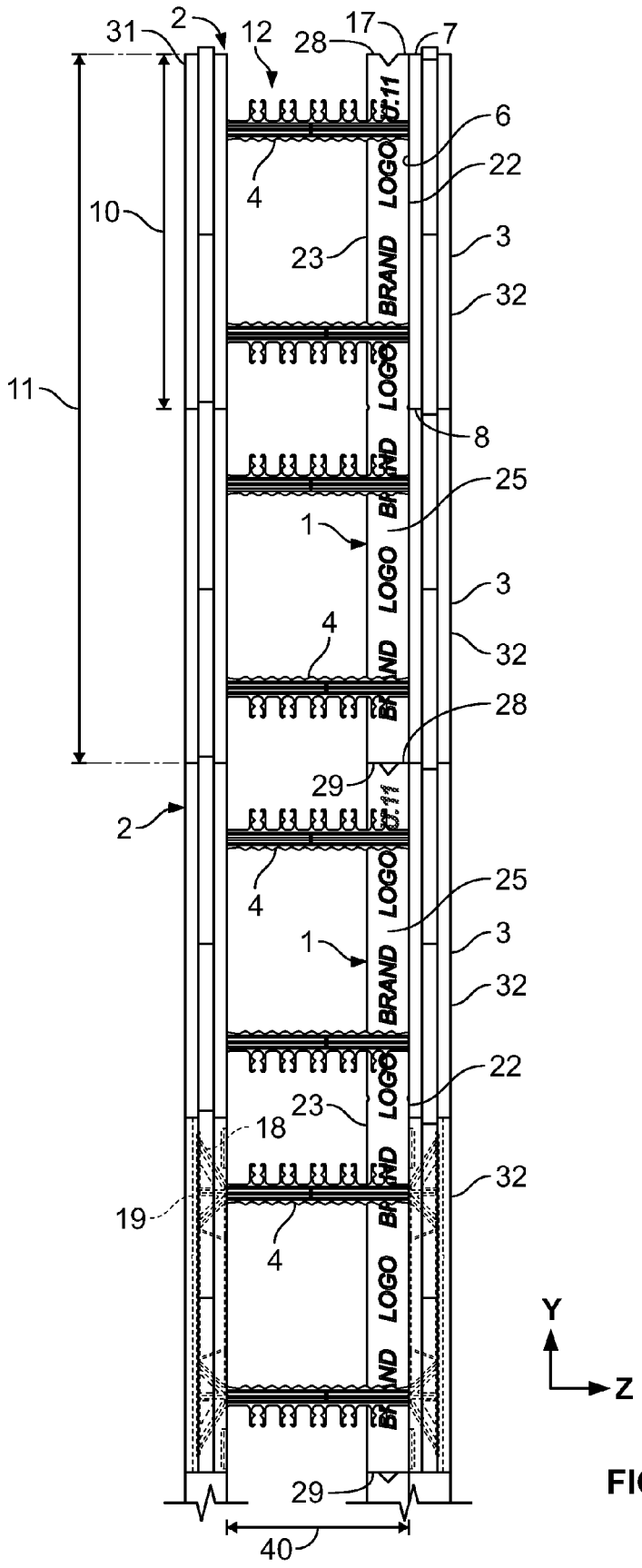
FIG. 8 is a front side view of an example of embodiments of the form insert of FIG. 1 installed in a stack of multiple insulated concrete forms.
Figure 9:
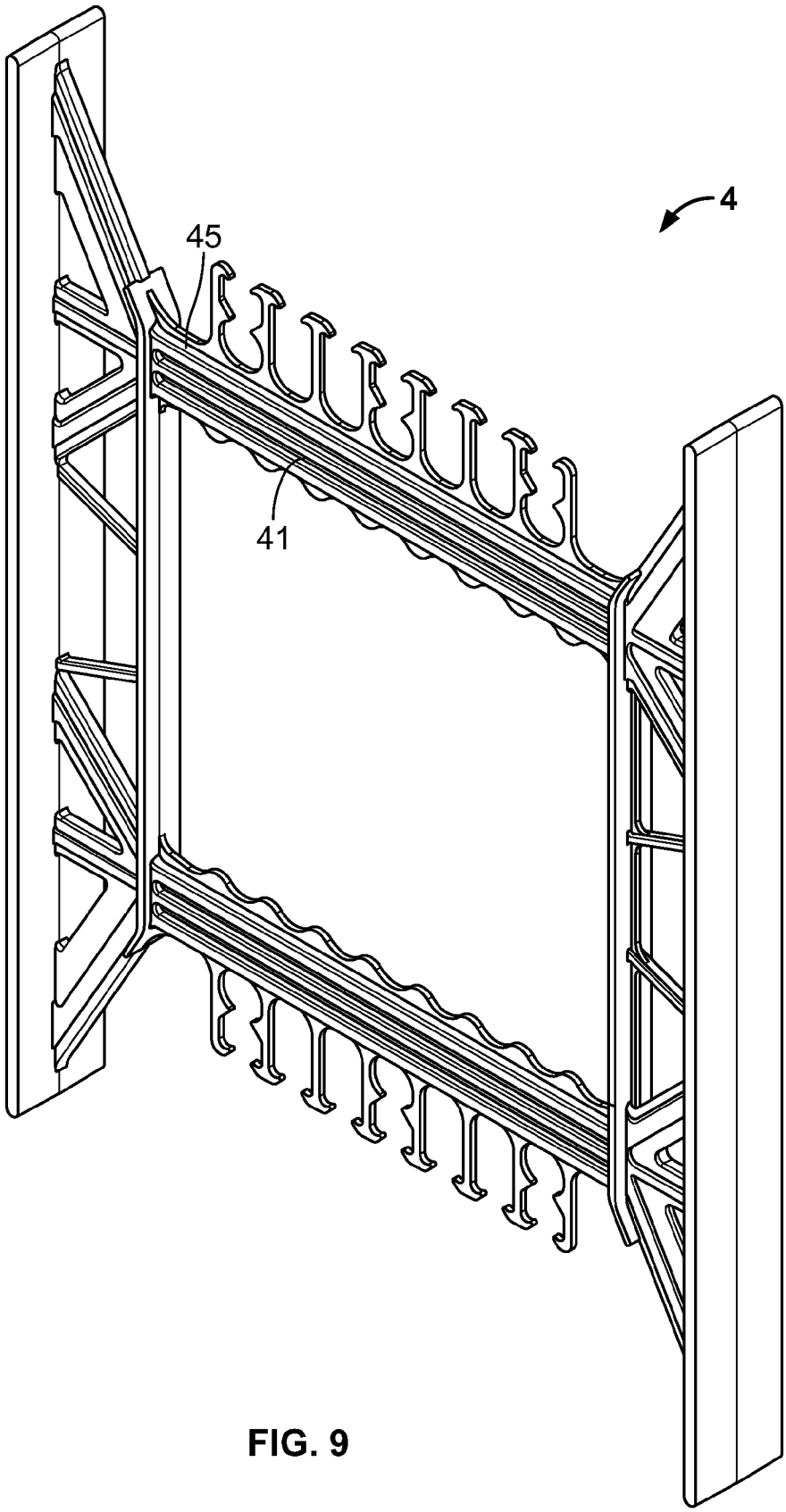
FIG. 9 is an example of a form tie.

Referring to FIGS. 7C and 8, in an embodiment, a form insert (1) can be positioned adjacent to or in contact with an interior surface (6) of a sidewall (3) of an insulated concrete form (2). Adjacent to or in contact as used herein are used synonymously and include direct contact, indirect contact, and adjoinment of the referenced structures. For example, a form insert can be positioned adjacent to or in contact with an interior surface of a sidewall and have an adhesive or thin film or thin sheet positioned between the form insert and the sidewall without departing from intended scope of adjacent or in contact as used herein. The insert (1) can be dimensioned to fit between the ties (4) of the form (2) and span the lateral space (5) therebetween. In addition, in an embodiment, an insert (1) can be dimensioned to span the height (10) of the form (2) from the top surface (7) of the sidewall (3) to the bottom surface (8) of the sidewall. As shown in FIGS. 7C and 8, an insert (1) can be dimensioned to span the height (11) of two stacked forms. In such embodiments, the insert can include a cut-line (20) marking the point where the insert can be cut to decrease the height of the insert to match the height of a single insulated concrete form. In addition, the insert can be positioned to cover the portion of the interior surface of a sidewall near the joint of two laterally adjoined forms. One advantage of the same is to cover the seam created by the lateral joining of two forms and thereby help prevent leaking through the seam.

Referring to 7B, in an embodiment, an outward face (22) of a form insert (1) can be positioned to cover an overall inside surface area or a portional surface area of the inside surface (6) of a sidewall (3). An example overall inside surface area can be defined in the vertical direction (y) between the first sidewall top surface (7) and the first sidewall bottom surface (8) and in the second horizontal direction (x) between the first sidewall front side (34) and the first sidewall rear side (35). An example portional surface area of an inside surface (6) of a sidewall (3) can be defined in the vertical direction (y) between the first sidewall top surface (7) and the first sidewall bottom surface (8) and in the second horizontal direction (x) between a first lateral member (38*a*) and a second lateral member (39*a*), as shown in FIG. 7B in the dotted box labeled with reference number 43. The form insert can be positioned to cover a percentage of the overall or portional surface area (43), including but not limited to about 50%, 55%, 60%, 65%, 70%, 75%, 80%, 85%, 90%, 95%, or substantially 100% of the portional surface area (43). In addition, in an embodiment, a plurality of form inserts can be positioned to cover, in accordance with the above referenced percentages, an inside surface of single insulating concrete form or the combined inside surfaces of plurality of interconnected insulated concrete forms, such as a stack or a course of insulated concrete forms.

Figure 11A:
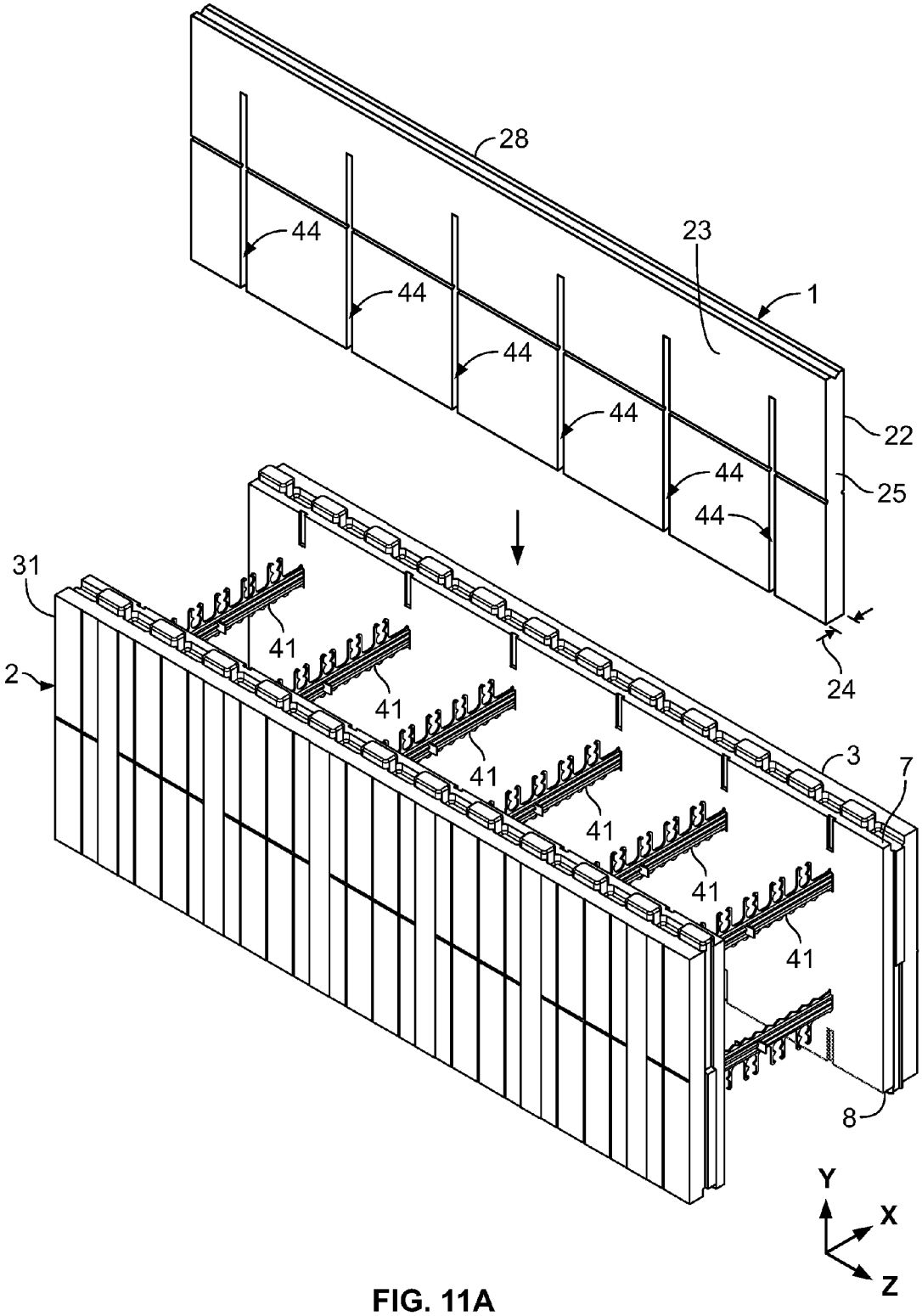
FIGS. 11A and 11B depict an embodiment of the form insert of FIG. 10 installed in an insulated concrete form.
Figure 11B:
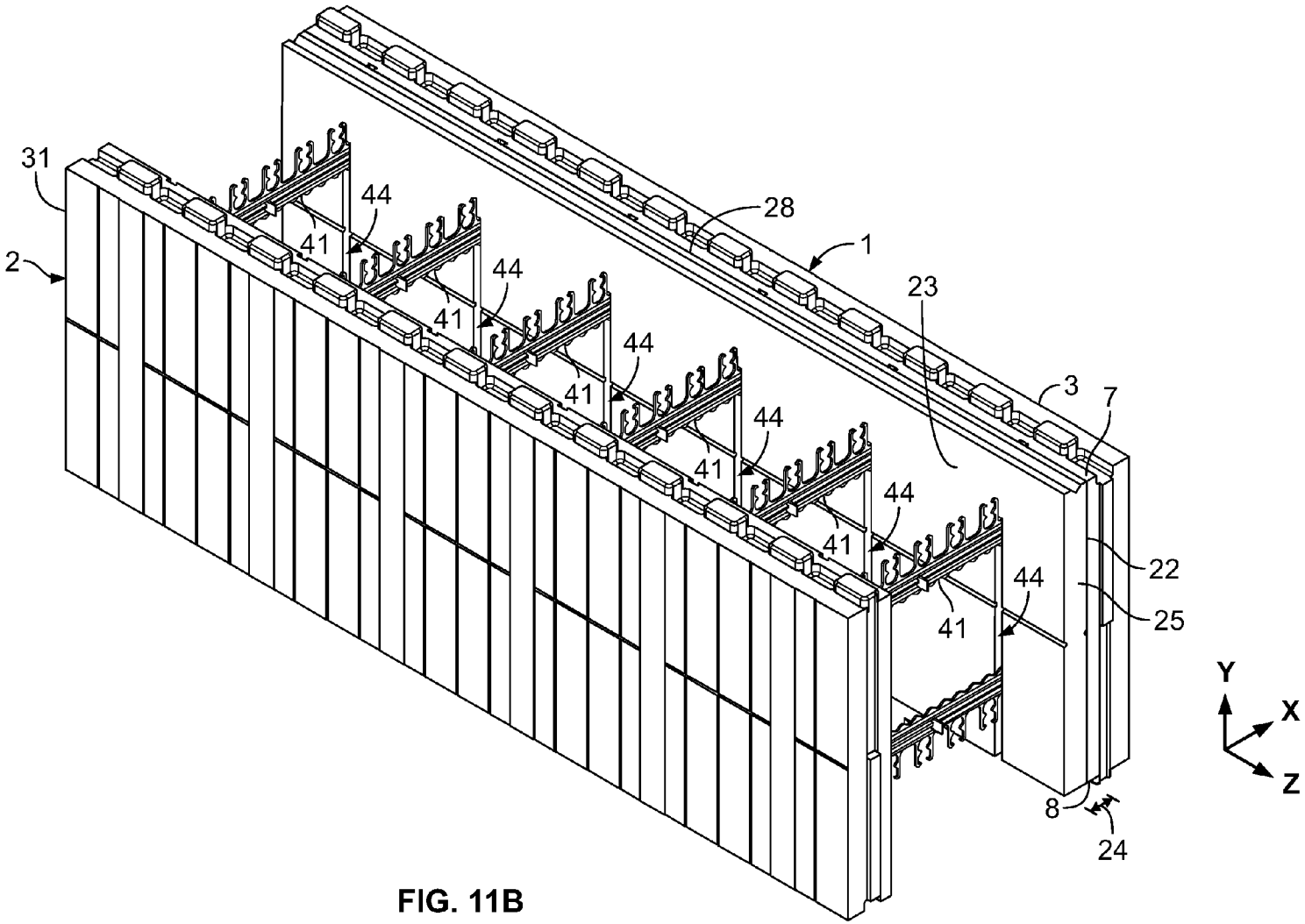

In addition, as shown in FIG. 8, in an embodiment, the insert (1) can be stacked, one on top of the other, to span the height of a stack of two forms (2). While FIG. 7C depicts a plurality of separate inserts positioned between a plurality of lateral members, in an embodiment, the insert can be formed of a single piece with multiple slots defined therein to accommodate multiple ties and span the lateral space between the multiple of ties. For example, referring to FIGS. 10, 11A, and 11B, seven form inserts can be formed into a single form insert with six slots defined therein in which the ties can be positioned, thereby spanning the lateral space between the spaced ties. In an embodiment, a form insert (1) can include a plurality of vertical slots (44) defined in the form insert (1), each of the vertical slots having an open end (44*a*) defined in the form insert bottom surface (29) and a closed end (44*b*) defined in the form insert (1) a distance from the form insert top surface (28). In an embodiment, the distance between the closed end (44*b*) and the top surface (28) can be from about 0.5 inch to about 6 inches. In an embodiment, the distance between the closed end (44*b*) and the form insert top surface (28) is about 3.5 inches. Each of the vertical slot (44) can be spaced in the second horizontal direction at distance (x) from at least one other of the vertical slots such that the distance corresponds to the form tie spacing distance so that the vertical slots accommodate a plurality of lateral members (41) of the plurality of form ties (4).

In addition, in an embodiment, form inserts can be installed on the interior surfaces of both, opposing sidewalls of the insulated concrete forms (not shown). In addition, in an embodiment, a second form insert can be positioned on an inward face of a first insert which was positioned on the interior surface (6) of a sidewall (3) to further increase the R-Value of the resulting structure.

In an embodiment, a form insert may also be formed of a single piece configured to span adjoining forms in the lateral direction. For example, a single insert may comprise a single piece of insulating material which spans the lateral dimension of two ICF blocks and thus includes slots that will accommodate placement over the ties associated with two adjoining ICF blocks. One advantage of such embodiment is that the insert can facilitate the joinder of the adjoined blocks.

In an embodiment, inserts may vary in thickness or material. In an embodiment, the form insert thickness (24) is about 5% to about 200% of the first sidewall thickness (33) and less than the cavity thickness (40). In an embodiment, the form insert thickness is about 0.5 inch to about 3.0 inches. In an embodiment, a form insert (1) can have an R-Value of about 5. In an embodiment, inserts may include additional features such as passageways for conduit, piping, sensors, or controls, or structures for gripping fasteners for wallboard or siding.

In an embodiment, an insert (1) can be dimensioned so as to fit between the lateral members (41) of the form ties (4) and engage the lateral members of the form ties (4) so as to create a friction fit. The insert length (27) of the form insert can be slightly greater than the spacing distance (42) between form ties so that the form insert (1) maintains contact with and is held in position by the lateral members of a pair of spaced form ties (4). The friction fit also assists to maintain the position of the form insert (1) against the interior surface (6) of the sidewall (3). In one embodiment, raised embossments (13) on the side of the insert (1) are used to enable the friction fit. The raised embossments (13) can be in the form of a brand name, logo, or R-value.

In addition, in an embodiment, the insert (1) includes a ledge (16*a*, 16*b*) on the front and rear side of the form insert near the top of the form insert. The ledges (16*a*, 16*b*) can be configured to engage a portion of a first upper surface (45) of the lateral members of a pair of form ties (4) so that the form insert (1) cannot be inserted below the position at which the ledges engages the form ties, thereby maintaining the top surface (17) of the insert flush or substantially aligned with the top surface (7) of the form (2). Substantially aligned as used herein means within plus or minus of about half an inch of being level or flush with the referenced surface. In an embodiment, the distance between each ledge (16*a*, 16*b*) and the form insert top surface (28) can be from about 0.5 inch to about 6 inches. In an embodiment, the distance between the ledge (16*a*, 16*b*) and the form insert top surface (28) is about 3.5 inches. In one embodiment, the form insert (1) can be about 32 inches high, about 7.50 inches wide, and about 2 inches thick. In an embodiment, the width of the insert (1) can vary from the top to the bottom. For example, in one embodiment, the top of the insert can be about 8 inches wide, the middle portion of the insert can be about 7.50 inches wide, and the bottom portion can be about 7.25 inches wide. In an embodiment, the insert can taper gradually from about the middle portion toward the bottom portion. In an embodiment, the insert can taper gradually from point at about 25% of the height of the insert toward the bottom portion. The term about as used herein for purposes of approximating length, height, or thickness means plus or minus fifteen percent.

In an embodiment, the insert (1) utilizes a tongue (14) and groove (15) structure to interlock stacked inserts. For example, FIG. 8 depicts stacked inserts positioned against the interior surface (6) of sidewalls (3) of stacked insulated concrete forms (2). The tongue (14) on the bottom of one insert fits into the groove (15) on the top of another insert. In an embodiment, as depicted in FIG. 6, the tongue (14) is on the top of the insert (1) and the groove is on the bottom, the tongue and groove being complimentary such that a like tongue can interlock with the groove and a like groove can interlock with the tongue. The interlocking of stacked inserts helps, for example, to prevent the inserts from separating from the interior surface (6) of the sidewall (3). Maintaining the position of the insert (1) against the interior surface (6) of the sidewall (3) is also facilitated by the weight of the concrete as the concrete is poured into the cavity (12).

In an embodiment, a kit can include at least one insulated concrete form as described herein and at least an embodiment of a form insert as described herein. In kit can include instructions for the user describing how the user can position a course of a plurality of insulating concrete forms such that the course is configured to receive poured concrete. A course is understood in the art and shown in U.S. Pat. No. 7,861,479 which is incorporated by reference. For example a course can include a portion of a structure wherein the course includes a plurality of interconnected exterior sidewalls having outside surface and an inside surface. In an embodiment, the instructions can describe how to position a plurality of inserts in contact with the inside surface of the interconnected exterior sidewalls such that the form inserts cover ate least about 80% of the surface area of the inside surface, as described herein. In an embodiment, the resulting R-Value the portion of the structure is greater than if the form inserts were not used and can result in an increase, for example of at least about R-4. In an embodiment, the increase to can be in between about R-9 and about R-18.

An advantage of us of an insert as described herein is to increase the R-Value of structures constructed with insulated concrete forms. R-Value as used herein can be measured using ASTM standards known in the art. The additional thickness of insulative material introduced to the form by the insert increases the R-Value of the resulting structure. For example, if the insulated concrete form provides an R-Value of 23, use of an insert with R-Value of 9 can increase the R-Value of the resulting structure to R-32. In various embodiments, the R-Value of a form insert can be about R-4 to about R-12, including each value in between. In an embodiment, the R-Value of a form insert can be increased by laminating an insulative film on an inward or outward face of the form insert. Another advantage is that the insert can be positioned on the interior surface of the sidewall which faces the exterior of the structure. Such placement increases the energy performance of the wall. Another advantage of us of an insert as described herein is that the insert can be utilized with existing designs of insulated concrete forms, thereby increasing the versatility of existing forms to be used in applications which require higher insulative standards. Another advantage associated with the compatibility of the insert with existing forms is that existing tie design need not be changed to accommodate additional insulative material (a front view of an example of a complete tie (18) is shown in ghost format in FIG. 8), thereby, for example, maintaining the position of the furring strip (19) near the exterior surface of the sidewall of the form and further increasing the versatility of existing form designs.

The detailed drawings, specific examples and particular embodiments given serve the purpose of illustration only. While some of the specific embodiments of the systems and methods described and shown herein concern building a vertical wall utilizing insulated concrete forms, the teachings of the present invention may be applied to apparatuses that build other structures using insulated concrete forms. In the foregoing specification, the invention has been described with reference to specific examples of embodiments of the invention. It will, however, be evident that various modifications and changes may be made therein without departing from the broader spirit and scope of the invention. Furthermore, the insert may have any suitable size and shape. Furthermore, the insert may be implemented as single or multiple pieces, while functionally operating as a single piece. Also, inserts functionally forming separate devices may be integrated in a single physical device. However, other modifications, variations and alternatives are also possible. The specifications and drawings are, accordingly, to be regarded in an illustrative rather than in a restrictive sense. While certain embodiments detail certain optional features as further aspects of the invention, the description is meant to encompass and specifically disclose all combinations of these features unless specifically indicated otherwise or physically impossible.

The invention claimed is:

1. An assembly comprising:

an insulated concrete form having a first sidewall, a second sidewall, and a plurality of form ties, wherein the first sidewall and the second sidewall are constructed of expanded polystyrene foam;

the first sidewall having an inside surface, an outside surface, and a first sidewall thickness defined in a first horizontal direction between the inside surface and the outside surface;

the first sidewall further having a first sidewall top surface, a first sidewall bottom surface, and a first sidewall height defined in a vertical direction between the first sidewall top surface and the first sidewall bottom surface;

the first sidewall further having a first sidewall front side, a first sidewall rear side, and a first sidewall length defined in a second horizontal direction between the first sidewall front side and the first sidewall rear side;

the plurality of form ties comprise a first form tie and a second form tie, wherein the first form tie and second form tie connect the first sidewall to the second sidewall such that the first form tie and the second form tie space the first sidewall from the second sidewall to define a cavity in between the first sidewall and the second sidewall, wherein a cavity thickness is defined in the first horizontal direction spanning between the first sidewall and the second sidewall;

the first form tie having a first lateral member oriented transverse the first sidewall and the second sidewall;

the second form tie having a second lateral member oriented transverse the first sidewall and the second sidewall;

the first lateral member is spaced a distance from the second lateral member in the second horizontal direction along the first sidewall length of the insulated concrete form, wherein the distance between the first lateral member and the second lateral member in the second horizontal direction along the first sidewall length of the insulated concrete form is defined as a form tie spacing distance;

wherein a first portional surface area of the inside surface of the first sidewall is defined in the vertical direction between the first sidewall top surface and the first sidewall bottom surface and in the second horizontal direction between the first lateral member and the second lateral member;

a form insert having a form insert outward face, a form insert inward face, and a form insert thickness defined in the first horizontal direction between the form insert outward face and the form insert inward face, wherein the form insert thickness is about 5% to about 200% of the first sidewall thickness and less than the cavity thickness;

the form insert further having a form insert front side, a form insert rear side, and a form insert length defined in the second horizontal direction between the form insert front side and the form insert rear side; and the form insert further having a form insert top surface, a form insert bottom surface, and a form insert height defined in the vertical direction between the form insert top surface and the form insert bottom surface;

the form insert further having a front ledge defined in the form insert front side and a rear ledge defined in the form insert rear side; wherein the front ledge is adapted to engage at least a portion of a first upper surface of the first lateral member and the rear ledge is adapted to engage at least a portion of a second upper surface of the second lateral member;

the form insert further being formed of an insulative material and having an R-Value of at least about 4;

wherein the form insert outward face is positioned in contact with the inside surface of the first sidewall such that the combined thickness of the first sidewall and the form insert is greater than the thickness of the second sidewall, and wherein the form insert outward face covers at least about 80% of the first portional surface area; and wherein the insulating concrete form and the form insert comprise permanent components of an insulated concrete structure comprising a concrete wall intermediate the form insert and the second sidewall of the insulated concrete form.

2. The assembly of claim 1 wherein the form insert is formed of expanded polystyrene foam and the form insert thickness is about 0.5 inch to about 3.0 inches and wherein the form insert front side is in contact with the first lateral member and the form insert rear side is in contact with the second lateral member.

3. The assembly of claim 1 wherein the plurality of form ties further comprise a plurality of lateral members, each of the plurality of lateral members being spaced a distance from at least one other of the plurality of lateral members in the second horizontal direction at a distance corresponding to the form tie spacing distance;

a plurality of form inserts, wherein the plurality of form inserts are positioned such that an outward face of the plurality of inserts is in contact with the inside surface of the first sidewall.

4. The assembly of claim 1, the form insert further having a plurality of vertical slots defined in the form insert, each of the vertical slots having an open end defined in the form insert bottom surface and a closed end defined adjacent the form insert top surface; each of the vertical slots being spaced in the second horizontal direction at distance from at least one other of the vertical slots, the distance corresponding to the form tie spacing distance such that the vertical slots accommodate a plurality of lateral members of the plurality of form ties.

5. The assembly of claim 1 wherein an overall inside surface area of the first sidewall is defined in the vertical direction between the first sidewall top surface and the first sidewall bottom surface and in the second horizontal direction between the first sidewall front side and the first sidewall rear side; and wherein the outward face of the form insert covers at least about 80% of the overall inside surface area of the first sidewall.

6. The assembly of claim 1, wherein the front ledge and rear ledge are positioned at a predetermined distance from the form insert top surface so that the form insert top surface is substantially aligned with the first sidewall top surface when the front ledge is engaged with the first upper surface of the first lateral member and the rear ledge is engaged with the second upper surface of the second lateral member.

7. The assembly of claim 1, wherein the form insert front side is in contact with the first lateral member and the form insert rear side is in contact with the second lateral member.

8. An assembly comprising:

an insulated concrete form having a first sidewall, a second sidewall, and a plurality of form ties, wherein the first sidewall and second sidewall are constructed of expanded polystyrene foam;

the first sidewall having an inside surface, an outside surface, and a first sidewall thickness defined in a first horizontal direction between the inside surface and the outside surface;

the first sidewall further having a first sidewall top surface, a first sidewall bottom surface, and a first sidewall height defined in a vertical direction between the first sidewall top surface and the first sidewall bottom surface;

the first sidewall further having a first sidewall front side, a first sidewall rear side, and a first sidewall length defined in a second horizontal direction between the first sidewall front side and the first sidewall rear side;

the plurality of form ties comprise a first form tie and a second form tie, wherein the first form tie and second form tie connect the first sidewall to the second sidewall such that the first form tie and the second form tie space the first sidewall from the second sidewall to define a cavity in between the first sidewall and the second sidewall, wherein a cavity thickness is defined in the first horizontal direction spanning between the first sidewall and the second sidewall;

the first form tie having a first lateral member oriented transverse the first sidewall and the second sidewall;

the second form tie having a second lateral member oriented transverse the first sidewall and the second sidewall;

the first lateral member is spaced a distance from the second lateral member in the second horizontal direction along the first sidewall length of the insulated concrete form, wherein the distance between the first lateral member and the second lateral member in the second horizontal direction along the first sidewall length of the insulated concrete form is defined as a form tie spacing distance;

wherein a first portional surface area of the inside surface of the first sidewall is defined in the vertical direction between the first sidewall top surface and the first sidewall bottom surface and in the second horizontal direction between the first lateral member and the second lateral member;

a form insert having a form insert outward face, a form insert inward face, and a form insert thickness defined in the first horizontal direction between the form insert outward face and the form insert inward face;

the form insert further having a form insert front side, a form insert rear side, and a form insert length defined in the second horizontal direction between the form insert front side and the form insert rear side; and the insert further having a form insert top surface, a form insert bottom surface, and a form insert height defined in the vertical direction between the form insert top surface and the form insert bottom surface;

a front ledge defined in the form insert front side and a rear ledge defined in the form insert rear side; wherein the front ledge engages a portion of a first upper surface of the first lateral member and the rear ledge engages a portion of a second upper surface of the second lateral member, wherein insert further having an R-Value of at least about 5;

wherein the form insert front side is in contact with the first lateral member and the form insert rear side is in contact with the second lateral member;

wherein the form insert outward face of the form insert is in contact with the inside surface of the first sidewall and wherein the form insert outward face of the form insert covers at least about 80% of the first portional surface area; and wherein the insulating concrete form and the form insert comprise permanent components of an insulated concrete structure comprising a concrete wall intermediate the form insert and the second sidewall of the insulated concrete form.

9. The assembly of claim 8, wherein the front ledge and rear ledge are positioned at a predetermined distance from the form insert top surface so that the form insert top surface is substantially aligned with the first sidewall top surface when the front ledge is engaged with the first upper surface of the first lateral member and the rear ledge is engaged with the second upper surface of the second lateral member.

10. The assembly of claim 9 wherein the form insert is formed of expanded polystyrene foam and the form insert thickness is about 0.5 inch to about 3.0 inches;

wherein the form insert length increases from the form insert bottom surface toward the form insert top surface over at least a portion of the form insert height.

11. The assembly of claim 8, wherein the form insert front side and the form insert rear side having raised embossments adapted to enable friction fit engagement between the form insert and the first and second lateral members and wherein the form insert thickness is about 5% to about 200% of the first sidewall thickness and less than the cavity thickness.

12. The assembly of claim 11 wherein the form insert top surface is substantially aligned with the first sidewall top surface.

13. The assembly of claim 8, further comprising a second insulated concrete form having a third sidewall and a fourth sidewall;

wherein the insulated concrete form is stacked onto the second insulated concrete form such that the first sidewall is stacked onto the third sidewall;

wherein the form insert outward face is positioned in contact with an inside surface of the third sidewall; and wherein the form insert top surface is substantially aligned with a top surface of the first sidewall and the form insert bottom surface is substantially aligned with a bottom surface of the third sidewall.

14. The assembly of claim 13, the form insert top surface having groove and the form insert bottom surface having a tongue, the tongue and groove being complimentary such that a like tongue can interlock with the groove and a like groove can interlock with the tongue.

15. A kit comprising:

an insulated concrete form having a first sidewall, a second sidewall, and a plurality of form ties, wherein the first sidewall and the second sidewall are constructed of expanded polystyrene foam;

the first sidewall having an inside surface, an outside surface, and a first sidewall thickness defined in a first horizontal direction between the inside surface and the outside surface;

the first sidewall further having a first sidewall top surface, a first sidewall bottom surface, and a first sidewall height defined in a vertical direction between the first sidewall top surface and the first sidewall bottom surface;

the first sidewall further having a first sidewall front side, a first sidewall rear side, and a first sidewall length defined in a second horizontal direction between the first sidewall front side and the first sidewall rear side;

the plurality of form ties comprise a first form tie and a second form tie, wherein the first form tie and second form tie connect the first sidewall to the second sidewall such that the first form tie and the second form tie space the first sidewall from the second sidewall to define a cavity in between the first sidewall and the second sidewall, wherein a cavity thickness is defined in the first horizontal direction spanning between the first sidewall and the second sidewall;

the first form tie having a first lateral member oriented transverse the first sidewall and the second sidewall;

the second form tie having a second lateral member oriented transverse the first sidewall and the second sidewall;

the first lateral member is spaced a distance from the second lateral member in the second horizontal direction along the first sidewall length of the insulated concrete form, wherein the distance between the first lateral member and the second lateral member in the second horizontal direction along the first sidewall length of the insulated concrete form is defined as a form tie spacing distance;

wherein a first portional surface area of the inside surface of the first sidewall is defined in the vertical direction between the first sidewall top surface and the first sidewall bottom surface and in the second horizontal direction between the first lateral member and the second lateral member;

a form insert having a form insert outward face, a form insert inward face, and a form insert thickness defined in the first horizontal direction between the form insert outward face and the form insert inward face;

the form insert further having a form insert front side, a form insert rear side, and a form insert length defined in the second horizontal direction between the form insert front side and the form insert rear side; and the insert further having a form insert top surface, a form insert bottom surface, and a form insert height defined in the vertical direction between the form insert top surface and the form insert bottom surface;

a front ledge defined in the form insert front side and a rear ledge defined in the form insert rear side; wherein the front ledge engages a portion of a first upper surface of the first lateral member and the rear ledge engages a portion of a second upper surface of the second lateral member, wherein insert further having an R-Value of at least about 5;

wherein the form insert front side is adapted to contact the first lateral member and the form insert rear side is adapted to contact the second lateral member;

wherein the form insert outward face of the form insert is adapted to contact the inside surface of the first sidewall and wherein the form insert outward face of the form insert is adapted to cover at least about 80% of the first portional surface area; and wherein the insulating concrete form and the form insert are adapted to comprise permanent components of an insulated concrete structure comprising a concrete wall intermediate the form insert and the second sidewall of the insulated concrete form.

16. The kit of claim 15 wherein the form insert is formed of expanded polystyrene foam, the form insert thickness is about 0.5 inch to about 3.0 inches, the form insert length increases from the form insert bottom surface toward the form insert top surface over at least a portion of the form insert height, the form insert thickness is about 5% to about 200% of the first sidewall thickness and less than the cavity thickness, and wherein the front ledge and rear ledge are positioned at a predetermined distance from the form insert top surface so that the form insert top surface is substantially aligned with the first sidewall top surface when the front ledge is engaged with the first upper surface of the first lateral member and the rear ledge is engaged with the second upper surface of the second lateral member.

17. An insulated concrete form assembly comprising:

an insulated concrete form component having a first insulated concrete form insulation material sidewall, a separate second insulated concrete form insulation material sidewall, and a plurality of tie members connecting the first and second sidewalls; wherein the first and second sidewalls are constructed of expanded polystyrene foam; wherein the first sidewall including an inside surface, a generally parallel outside surface, and a generally uniform maximum first sidewall thickness defined between the inside surface and the outside surface; the first sidewall further including a first sidewall top surface, a first sidewall bottom surface, and a first sidewall height defined in a direction between the first sidewall top surface and the first sidewall bottom surface, said first sidewall height generally transverse to said first sidewall thickness;

the first sidewall further including a sidewall first edge side, a sidewall second edge side spaced from the first edge side, and a first sidewall length between the first edge side and the second edge side;

said second sidewall spaced from said first wall by at least two form ties connecting said first and second sidewalls to define cavity between the first sidewall and the second sidewall, said cavity having a first dimension between the first sidewall and the second sidewall;

at least two said form ties separated from each other in said cavity by a fixed spacing distance portion of said first sidewall length;

wherein a first portion surface area of the inside surface of the first sidewall is defined bounded between the first sidewall top surface and the first sidewall bottom surface and the first form tie and the second form tie;

a separate insulating material form insert having an insert first face, an insert second face, and an insert thickness between the insert first face and the insert second face, wherein the insert thickness is in the range of about 5% to about 200% of the first sidewall thickness and is less than the cavity first dimension;

the form insert further having an insert first side, an insert second side generally transverse to the first face and second face, and an insert length between the insert first side and the insert second side; and the form insert further having an insert top surface, an insert bottom surface, and an insert height between the insert top surface and the insert bottom surface generally transverse to the first face and second face and transverse to the first side and second side;

the form insert further having a front ledge defined in the first side and a rear ledge defined in the second side; wherein the front ledge engages a portion of the first form tie and the rear ledge engages a portion of the second form tie;

wherein the form insert further having an R-Value of at least about 5;

wherein the front ledge and rear ledge are positioned at a predetermined distance from the insert top surface so that the insert top surface is substantially aligned with the first sidewall top surface when the front ledge is engaged with the portion of the first form tie and the rear ledge is engaged with the portion of the second form tie;

wherein the first face of the insert is positioned against the inside surface of the first sidewall and wherein the first face of the insert covers at least a fraction of the first portion surface area in the cavity of the inside face of said first sidewall whereby the volume of the cavity is reduced generally by the volume of the form insert in contact with the portion surface area of the first sidewall inside face cavity, said concrete form and separate insert form in combination a modified mold cavity bounded by insulating material comprised of said first and second sidewalls and said form insert, wherein the concrete form and separate insert comprise permanent components of an insulated concrete structure comprising a concrete wall the separate insert and the second sidewall of the concrete form.

18. A form insert for use with an insulated concrete form having a first sidewall, a second sidewall, and a plurality of form ties, wherein the first sidewall and the second sidewall are constructed of expanded polystyrene foam, wherein the first sidewall and the second sidewall are positioned opposite each other in a spaced apart relationship, the plurality of form ties extending transversely between the first sidewall and the second sidewall, each form tie having a lateral member, the form insert comprising:

a form insert outward face, a form insert inward face, and a form insert thickness defined in a first horizontal direction between the form insert outward face and the form insert inward face;

the form insert further having a form insert front side, a form insert rear side, and a form insert length defined in a second horizontal direction between the form insert front side and the form insert rear side;

the form insert further having a form insert top surface, a form insert bottom surface, and a form insert height defined in the vertical direction between the form insert top surface and the form insert bottom surface;

the form insert further having a front ledge defined in the form insert front side and a rear ledge defined in the form insert rear side; wherein the front ledge is adapted to engage a first lateral member and the rear ledge is adapted to engage a second lateral member when the form insert is positioned within an insulated concrete form in between the first and second lateral members;

the form insert further being formed of an insulative material and being adapted to increase the R-Value of a resulting structure of concrete wall intermediate the first sidewall and second sidewall of the insulated concrete form by at least about 4; and wherein the insulating concrete form and the form insert are adapted to comprise permanent components of an insulated concrete structure comprising a concrete wall intermediate the form insert and the second sidewall of the insulated concrete form.

19. The form insert of claim 18 wherein the front ledge and the rear ledge are positioned at a predetermined distance from the form insert top surface such that the form insert is adapted so that the form insert top surface is substantially aligned with a first sidewall top surface when the front ledge is engaged with the first lateral member and the rear ledge is engaged with the second lateral member.

20. The form insert of claim 19 wherein at least one of the front ledge and the rear ledge is in the form of a vertical slot defined in the form insert.

21. The form insert of claim 20 wherein an open end of the vertical slot is defined in the form insert bottom surface.

22. The form insert of claim 1 wherein at least one of the front ledge and the rear ledge is in the form of a vertical slot defined in the form insert.

23. The form insert of claim 22 wherein an open end of the vertical slot is defined in the form insert bottom surface.

* * * * *